US006314864B1

(12) United States Patent
Beck et al.

(10) Patent No.: US 6,314,864 B1
(45) Date of Patent: Nov. 13, 2001

(54) CLOSED CAVITY PISTON FOR HYDROSTATIC UNITS

(75) Inventors: Richard A. Beck, Huxley; Robert J. Stoppek, Ames, both of IA (US)

(73) Assignee: Sauer-Danfoss Inc., Ames, IA (US)

( * ) Notice: Subject to any disclaimer, the term of this patent is extended or adjusted under 35 U.S.C. 154(b) by 0 days.

(21) Appl. No.: 09/620,097

(22) Filed: Jul. 20, 2000

(51) Int. Cl.[7] ..... F01B 31/10
(52) U.S. Cl. ..... 92/157; 92/260
(58) Field of Search ..... 92/71, 157, 158, 92/260

(56) References Cited

U.S. PATENT DOCUMENTS

| | | | |
|---|---|---|---|
| 3,187,644 | 6/1965 | Ricketts | 92/248 |
| 3,319,575 | 5/1967 | Havens | 103/162 |
| 3,707,113 | 12/1972 | Hein et al. | 92/248 |
| 3,741,077 | 6/1973 | Hulsebus et al. | 92/57 |
| 3,882,762 | 5/1975 | Hein | 92/181 |
| 3,896,707 | 7/1975 | Holmstrom | 92/172 |
| 3,915,074 | 10/1975 | Bristow et al. | 92/172 |
| 3,984,904 | 10/1976 | Schlecht | 29/156.5 R |
| 3,986,439 | 10/1976 | Ring | 92/158 |
| 3,999,468 | 12/1976 | Bristow et al. | 92/248 |
| 4,191,095 | 3/1980 | Heyl | 92/78 |
| 4,216,704 | 8/1980 | Heyl | 92/78 |
| 4,494,448 | 1/1985 | Eystratov et al. | 92/172 |
| 4,519,300 | 5/1985 | Adomis, Jr. et al. | 92/158 |
| 5,007,332 | 4/1991 | Wegenseil | 92/181 |
| 5,072,655 | 12/1991 | Adler | 92/160 |
| 5,076,148 | 12/1991 | Adler | 92/158 |
| 5,216,943 | 6/1993 | Adler et al. | 92/157 |
| 5,265,331 | 11/1993 | Engel et al. | 29/888.044 |
| 5,490,446 | 2/1996 | Engel | 92/157 |
| 5,553,378 | 9/1996 | Parekh et al. | 29/888.044 |
| 5,642,654 | 7/1997 | Parekh et al. | 92/260 |
| 5,758,566 * | 6/1998 | Jepsen et al. | 92/187 |

* cited by examiner

*Primary Examiner*—Edward K. Look
*Assistant Examiner*—Thomas E. Lazo
(74) *Attorney, Agent, or Firm*—Zarley, McKee, Thomte, Voorhees & Sease

(57) ABSTRACT

A closed cavity piston assembly includes a piston body, a separately formed piston cap sealingly joined to the body, and an elongated stem integrally formed with one of the piston body or the cap. In one embodiment, the stem is integrally formed with the piston body. In another embodiment, the stem is integrally formed with the piston cap and slidably journaled in and sealed to a hole in the bottom of the piston body. The cap of the piston assembly also has a surface for engaging a slipper. In either case, a fluid passageway extends through the stem, body, and cap of the piston assembly. The passageway is remote from the side wall of the piston body and fluidly isolated from the main interior cavity of the hollow piston body once the cap and body are sealingly joined together. The piston assembly can be pivotally attached to a slipper that has its own fluid passageway, which registers with the passageway in the cap, to provide fluid for slipper lubrication and balance.

33 Claims, 6 Drawing Sheets

CLOSED CAVITY PISTON FOR HYDROSTATIC UNITS

BACKGROUND OF THE INVENTION

The present invention relates to a closed cavity piston assembly for reciprocation in the rotating cylinder block of a hydrostatic unit, such as a pump or a motor. As a result of the unique geometry of the piston assembly components, they can be formed with cost-effective processes involving little or no machining, such as metal injection molding.

Solid steel pistons are well known and have been utilized in the rotatable cylinder blocks of hydrostatic power units. Solid steel pistons are durable, reliable, and relatively inexpensive to make. However, their weight tends to impose limitations on the speed of operation for the cylinder blocks in which they are used. They also develop more operational frictional forces.

Consequently, some manufacturers have searched for cost-effective methods of producing hollow pistons. Open-ended hollow pistons have been produced that weigh less than their solid pistons counterparts, but these hollow pistons do not reduce the compressed oil volume of the hydrostatic unit. Therefore, some manufacturers have welded a cap over the open end of the piston body to form a closed internal cavity in the piston. This reduces the compressible oil volume of the hydrostatic unit. Reduced compressible oil volume is desirable because it provides better control of swashplate moments and better efficiency in swashplate controlled hydrostatic power units.

Although closed cavity hollow pistons can reduce compressed oil volume, they also present some unique problems of their own. Fluid for lubrication and balance is desired at the running surface of a slipper pivotally attached to the piston. One common way to supply such fluid is via a small fluid passageway extending longitudinally through the center of the piston and registering with a similar passage in the slipper. Because introducing fluid into the interior cavity of the hollow piston for this purpose would defeat the purpose of reducing the compressible oil volume, the interior cavity is generally filled with a material such as plastic that is lighter and less compressible than oil. Then the filled piston is drilled to provide the small, centrally located fluid passageway. The filling and drilling operations significantly increase the cost of the hollow pistons and therefore the cost of the hydrostatic units in which multiples of the pistons are used. It is also difficult to get reliable material that can endure the harsh environment of the pistons. Thus, deterioration of the plastic material is a common problem. Aluminum slugs, which are more durable than plastic, have been tried, but they are more difficult to retain within the cavity.

Some pistons include at least three separate and distinct components: a piston body, a piston cap and a hollow tube. The tube is positioned within the cavity and attached to the piston body by one or more washers that extend radially between the outer wall of the tube and the inner wall of the piston body. While pistons of this design solve at least some of the problems outlined above, they are very expensive to make.

Therefore, a primary objective of this invention is the provision of a piston assembly that is cost-effective to produce and reduces the number of finishing operations.

Another objective of this invention is the provision of a hollow or reduced volume piston assembly whose components can be fabricated using metal injection molding techniques then sealingly joined together.

Another objective of this invention is the provision of an economical closed cavity hollow piston with a centrally located fluid passageway extending longitudinal therethrough that is isolated from the rest of the interior cavity.

Another objective of this invention is the provision of a closed cavity piston that has a hollow stem fixed inside the cavity without annular washers attaching it to the wall.

Another objective of this invention is the provision of a closed cavity hollow piston having only two components, a piston body and a piston cap, one of which includes a centrally located hollow stem integrally formed therewith.

Another objective of this invention is the provision of a piston assembly that is easy to assembly due to complementary alignment features on the cap and piston body.

Another objective of this invention is the provision of a hydraulic piston assembly that is quiet and efficient in operation, as well as being capable of being operated in a cylinder block that is rotated at high speeds.

Another objective of this invention is the provision of a piston assembly that is durable and reliable in use.

These and other objectives will be apparent to one skilled in the art from the drawings, as well as from the following description and the claims.

SUMMARY OF THE INVENTION

This invention relates to a closed cavity piston assembly for reciprocation in the rotating cylinder block of a hydrostatic power unit, such as a pump or motor. The invention provides an efficient, durable, reliable and yet economical piston assembly.

A closed cavity piston assembly of this invention includes a hollow piston body, piston cap, and an elongated stem attached to the piston body and the piston cap. The piston body and piston cap are formed separately, then sealingly joined together to enclose and define an interior cavity. In one embodiment, the stem is integrally formed with the piston body and is disposed inside the cavity. In another embodiment, the stem is integrally formed with the piston cap and slidably journaled in a hole in the bottom of the piston body. The stem protrudes from a head on the cap. The head portion of the cap and the stem are sealingly joined to the piston body to enclose the cavity. A fluid passageway can be provided through the stem, body, and cap of the piston assembly. The end of the cap opposite the stem can include a surface thereon for engaging a slipper. The slipper is pivotally attached at the cap to form a piston and slipper assembly.

DETAILED DESCRIPTION OF THE PREFERRED EMBODIMENTS

Figure 1:
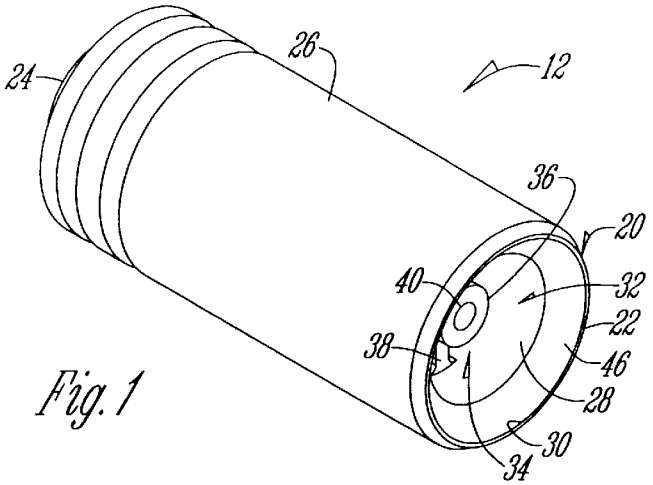
FIG. 1 is a perspective view of the piston body utilized in one embodiment of the invention.
Figure 2:
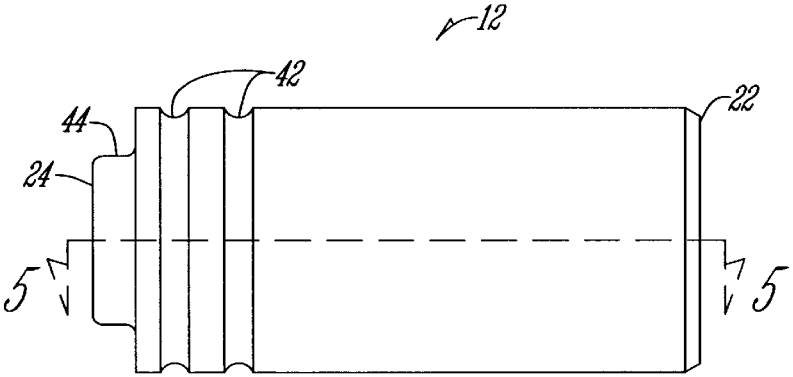
FIG. 2 is front elevation view of the piston body in FIG. 1.
Figure 3:
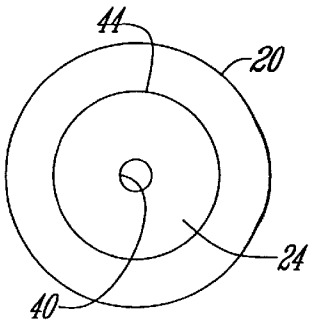
FIG. 3 is a left end elevation view of the piston body shown in FIG. 2.
Figure 4:
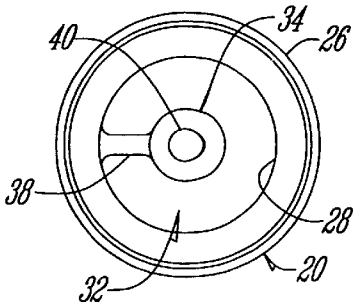
FIG. 4 is a right end elevation view of the piston body of FIG. 2.

Two embodiments of the present invention are described herein. A piston and slipper assembly utilizing a first embodiment of the closed cavity piston assembly of this invention is shown in FIGS. 1–9 and is designated by the reference numeral 10. A second embodiment of the closed cavity piston assembly is illustrated in FIGS. 10–15 as a part of a piston and slipper assembly designated by reference numeral 10A.

Referring to FIGS. 1–5, the piston and slipper assembly 10 includes a piston body 12, a separately formed piston cap 14 sealingly joined to the body 12 to form a closed cavity piston assembly 16, and a slipper 18 pivotally attached to the cap 14.

The elongated cylindrical piston body 12 includes an outer side wall 20, a bottom wall 21, and opposite first and second ends 22, 24. The outer side wall 20 and the bottom wall 21 each have outer and inner surfaces 26, 28, 29, 31 respectively. An opening 30 is provided in the first end 22 of the piston body 12 and defines the entrance to an internal cavity 32. In the embodiment shown, the cavity 32 is cylindrical and the surfaces 26, 28 concentrically surround the cavity.

Figure 5:
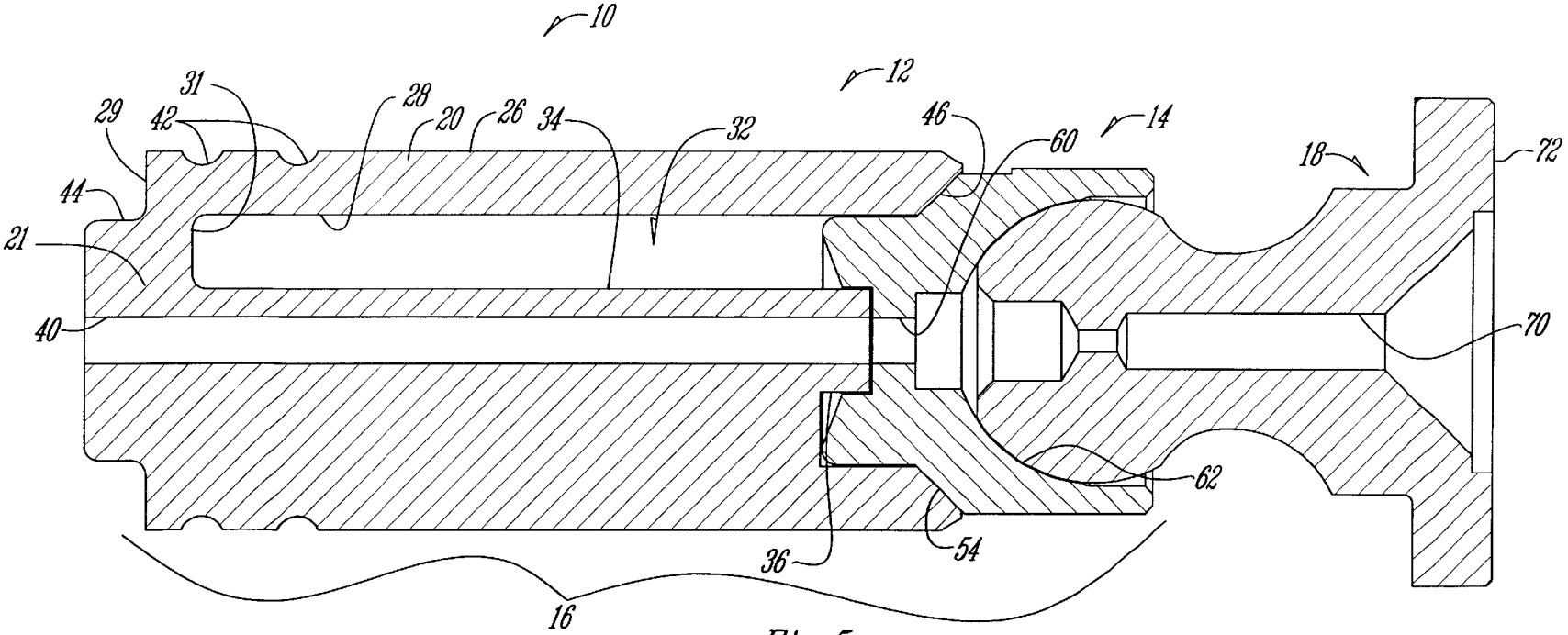
FIG. 5 is a cross-sectional view of the completed piston and slipper assembly of this invention when the piston body is sectioned along line 5—5 in FIG. 2.
Figure 6:
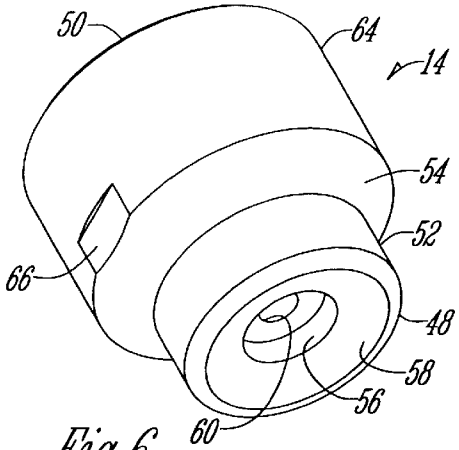
FIG. 6 is perspective view of the piston cap shown in FIG. 5.
Figure 7:
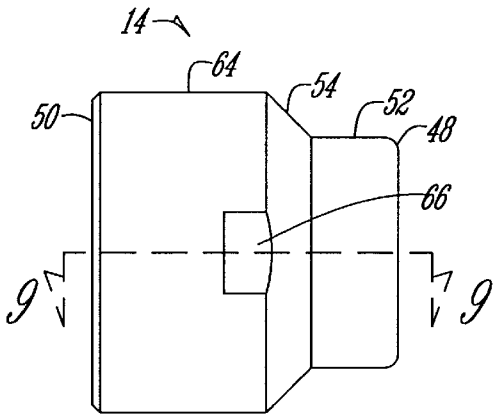
FIG. 7 is front elevation view of the piston cap of FIG. 6.
Figure 8:
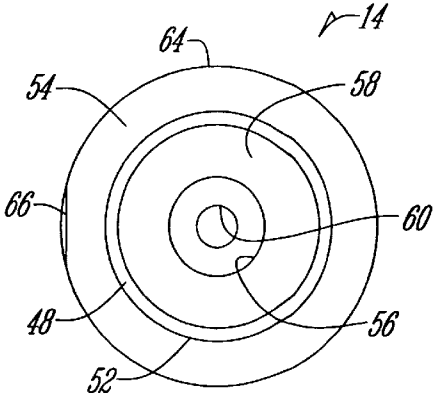
FIG. 8 is right end elevation view of the piston cap of FIG. 7.
Figure 9:
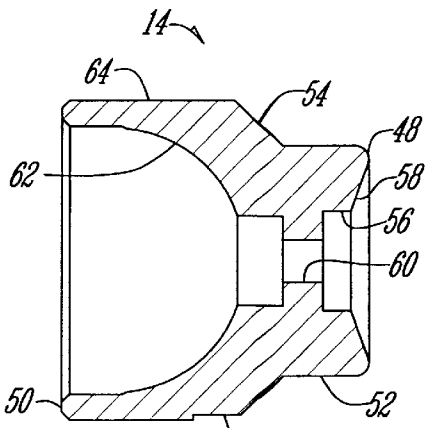
FIG. 9 is a cross-sectional view of the piston cap taken along line 9—9 in FIG. 7.
Figure 10:
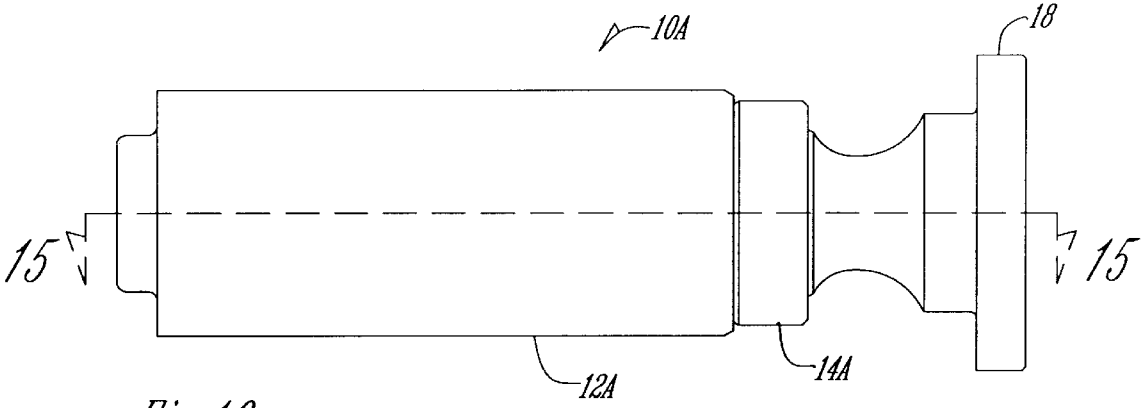
FIG. 10 is a front elevation view of a second embodiment of the piston and slipper assembly of the present invention.
Figure 11:
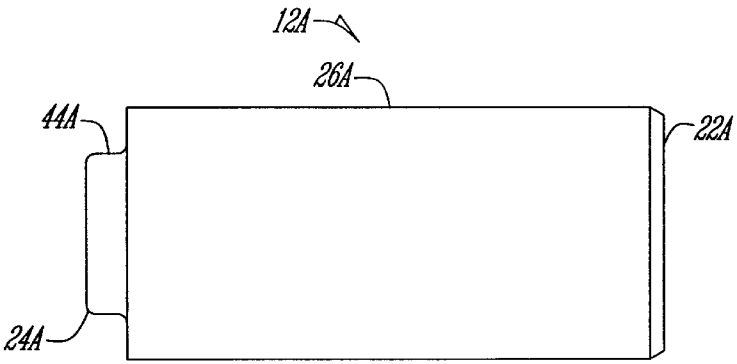
FIG. 11 is a front elevation view of the piston body of FIG. 10.
Figure 13:
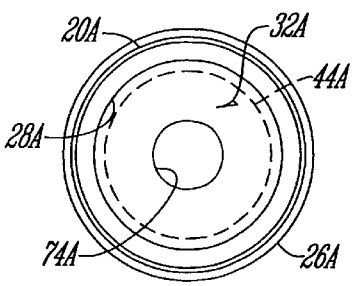
FIG. 13 is a right end elevation view of the piston body of FIG. 11.
Figure 12:
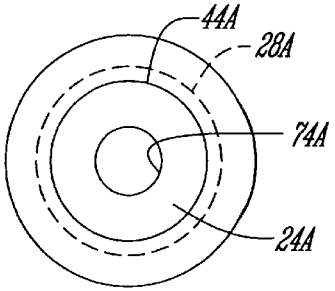
FIG. 12 is a left end elevation view of the piston body of FIG. 11.
Figure 14:
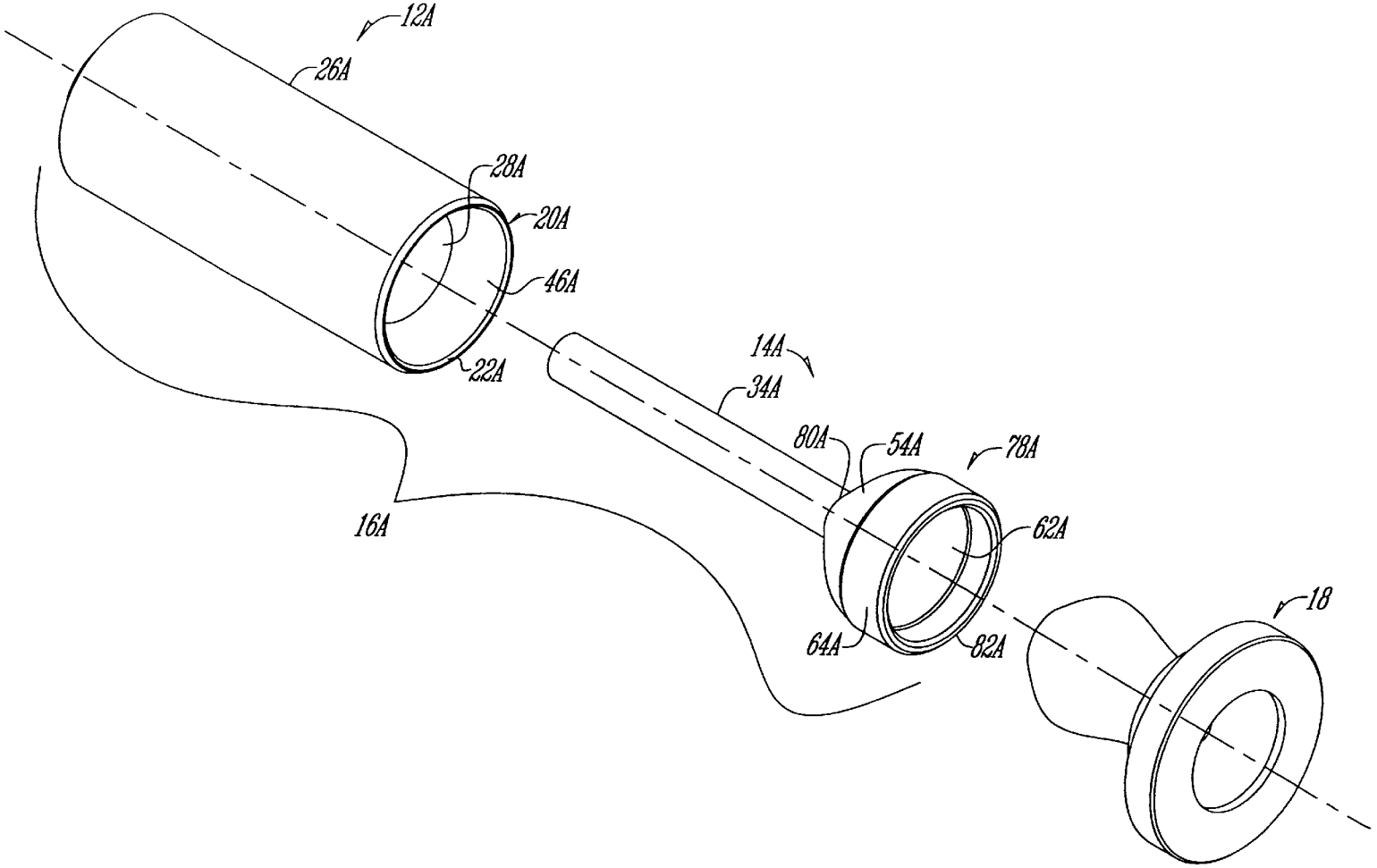
FIG. 14 is an exploded assembly view of the piston assembly of FIG. 10.

An elongated stem 34 is integrally and continuously formed with the piston body 12. Thus, as best seen in FIG. 5, the stem 34 shares a continuous uninterrupted or unbroken cross section with the rest of the piston body 12. The stem 34 protrudes upwardly from the inner surface 31 of the bottom wall 21 of the body 12. The stem 34 has a free end 36 that extends inside the internal cavity 32 toward the entrance or opening 30. The stem 34 is centrally located within the piston body 12, offset from and concentric with the inner cylindrical surface 28. A rigid web of material 38 optionally interconnects the stem 34 with the inner surface 28 of the outer wall 20 along a portion of the length of the stem. The free end 36 of the stem 34 extends farther toward the opening 30 than the web 38 for reasons that will become apparent later. The web 38 provides the stem 34 with additional support and rigidity during fabrication of the piston body 12.

A fluid passageway 40 can be provided through the stem 34 and completely through the bottom wall 21 of the piston body 12, as shown. The fluid passageway 40 provides a centralized isolated path for oil to flow through the hollow piston body 12 without going through the outer side wall 20 of the piston body 12 or filling the interior cavity 32. One or more grooves 42 can optionally be provided in the outer surface 26 of the piston body 12. The piston body 12 has a reduced diameter portion 44 adjacent the second end 24.

A surface 46 for mating with the cap 14 resides at the opposite end 22 of the piston body 12. In the embodiment shown in FIG. 5, the cap-mating surface 46 results from a tapered chamfer at the entrance of the opening 30. The surface 46 is a substantially straight surface extending conically around the opening 30. However, as understood from FIGS. 5 and 15, the cap-mating surface can also be spherically concave or have another profile, so long as the profile is conducive to sealingly mating the body and the cap. A small annular rib may even be helpful on one or both of the parts to facilitate sealingly joining them.

The piston cap 14 of the first embodiment of the invention appears in greater detail in FIGS. 6–9. The generally cylindrical piston cap 14 has first and second ends 48, 50. The first end 48 has a reduced diameter portion 52 that slidingly fits into the upper portion of the cavity 32 and a body-engaging surface 54 formed thereon adjacent to the reduced diameter portion 52. The body-engaging surface 54 is shaped so as to mirror or sealingly mate with the cap-mating surface 46 of the piston body 12. Thus, the surface 54 can be a straight conical surface (FIG. 5), a spherical surface (FIG. 15), or another shape that mirrors or mates with the surface 46 to define a sealed surface or line of contact. A centrally located hole 56 extends into the first end 48 of the cap 14 for receiving the stem 34. To guide the stem 34 into the hole 56 during assembly, a countersink 58 extends concentrically around the hole 56. Thus, the body 12, cap 14 and stem 34 are essentially self-aligning during assembly. A fluid passageway 60 extends through the cap 14 and generally registers with the fluid passageway 40 in the stem 34 and piston body 12 when the piston assembly 16 is completed. See FIG. 5.

The second end 50 of the piston cap 14 has a slipper-engaging surface 62 formed thereon. In the embodiment shown in FIGS. 5 and 9, the slipper-engaging surface 62 is a ball socket recess formed in the second end 50 of the cap 14. However, one skilled in the art will appreciate that the slipper 18 could be equipped with a ball socket recess and the appropriate slipper-engaging surface 62 would then be a mating surface formed as a portion of a spherical ball. The cap 14 has an enlarged diameter portion 64 adjacent the second end 50 of the cap 14, which prevents the cap from falling into the cavity 32 and ensures that the cavity is closed once the cap is securely in place. A notch 66 is provided in the enlarged diameter portion 64 adjacent to the body-engaging surface 54. The notch 66 intersects the surface 54.

A fluid passageway 70 is provided through the slipper 18. The fluid passageway 70 generally registers with the fluid passageway 40 in the cap. With the structure shown, oil can flow through the assembled piston assembly, including the slipper 18. Oil for lubrication and balance is thus provided to the running face 72 of the slipper 18 without completely filling the cavity 32. See FIG. 5.

The piston body 12 and the cap 14 are preferably made of a strong and durable metal, such as steel or iron. The shapes of the piston body 12 and cap 14 are conducive to being formed by casting or molding. Preferably, these parts are formed by metal injection molding techniques such that little, if any, subsequent machining operations are required. The cavity 32 and stem 34 can be provided with one core or core pin, and the hole 40 can be provided with another core pin extending through the mold used to make the piston body 12.

To assemble the piston assembly 16, the piston body 12 is placed with the entrance to the cavity 32 pointing up. The assembler then drops the cap 14 onto the stem 34 and the entrance to the cavity 32. The surface 46 and the chamfer 58 guide the cap 14 so that it is centered. Then the cap 14 is sealingly joined to the piston body 12 and the stem 34 by welding or brazing. The preferred process is brazing. Brazing material is applied to the joint at surface 46 through the notch 66, which acts as a gate. Brazing material is also applied to the stem and cap interface around hole 56 and the end 36 of the stem through the passageway 60. Alternatively, the brazing material can be applied in advance in the area of the chamfer 58 and melted by heating the stem end 36 or cap 14 in that area. Of course, almost any brazing or welding process can be used to join the piston body 12, stem 34, and cap 14, so long as the process provides a sealed joint in the form of a surface or line of contact. A slipper 18 pivotally attaches to the cap 14 by crimping, rolling, swedging or other conventional methods to form the completed piston and slipper assembly 10.

A second embodiment of the present invention is shown in FIGS. 10–15. In this embodiment, the piston and slipper assembly 10A includes a piston body 12A and a piston cap 14A sealingly joined together to form a piston assembly 16A. The hollow piston assembly 16A pivotally attaches to the slipper 18. The main differences between the first and second embodiments of the invention relate to the structure of the piston body 12A, the piston cap 14A and the location of the stem 34A.

Figure 15:
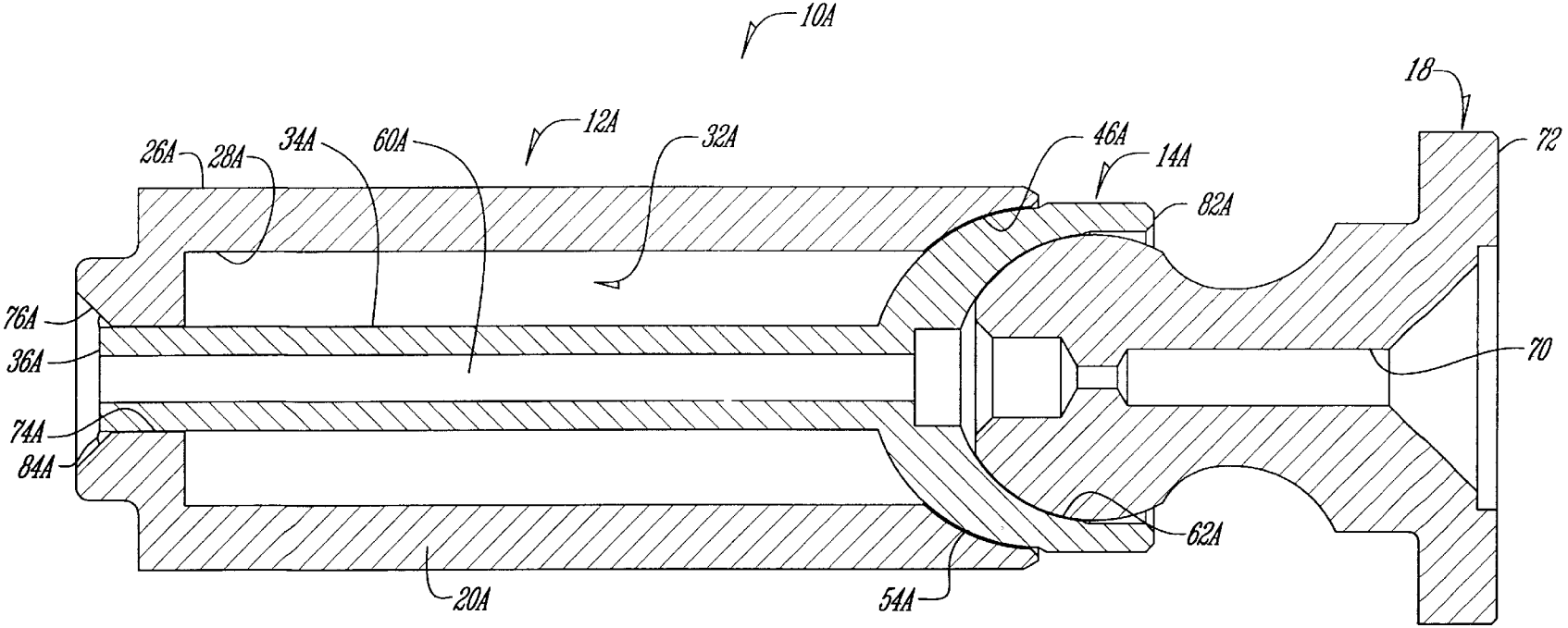
FIG. 15 is a central longitudinal cross-sectional view of the piston and slipper assembly taken along line 15—15 in FIG. 10.

The piston body 12A has an outer wall 20A, first and second ends 22A, 24A, an outer cylindrical surface 26A, an inner cylindrical surface 28A, an opening 30A and an internal cavity 32A. However, the piston body 12A does not include a stem or web integrally formed therein. Instead, a hole 74A for receiving the stem 34A is provided in the second end 24A of the piston body 12A. A countersink 76A concentrically surrounds the hole 74A, as shown in FIG. 15. A cap-mating surface 46A is formed in the first end 22A of the body 12A. In this embodiment, the cap-mating surface is a concave spherical recess or socket. As previously discussed, other surface profiles could be used without detracting from the invention.

The piston cap 14A has an enlarged head portion 78A with opposite first and second ends 80A, 82A. The elongated stem 34A protrudes from the first end 80A of the head portion 78A and is integrally formed therewith. As best seen in FIG. 15, the stem 34A is preferably hollow and includes a fluid passageway 60A that extends all of the way through the cap 14A. The stem 34A is long enough so that its free end 36A extends into the hole 74A in the piston body 12A when the cap 14A is attached to the piston body. The cap 14A has a convex spherical surface 54A for mating with the surface 46A of the piston body 12A. The mating spherical surfaces 46A and 54A assist in the alignment of the stem 34A so that it registers with the hole 74A during the assembly process. Similar to the first embodiment, the cap 14A has a slipper-engaging surface 62A formed on its second end 82A. A slipper 18 pivotally attaches to the cap 14A by crimping, rolling, swedging or other conventional methods to form the completed piston and slipper assembly 10A.

Again, the shapes of the piston body 12A and cap 14A are metallic and suitable for being formed by casting or, more preferably, by metal injection molding techniques.

To assemble the piston assembly 16A of the second embodiment, the piston body 12A is placed with the entrance to the cavity 32A facing up. The operator inserts the stem 34A of the cap 14A into the cavity 32A. The spherical surface 54A on the head portion 78A of the cap 14A helps center the stem 34A and guide it into the hole 74A at the second end of the piston body 12A. Once the surface 54A of the cap 14 rests on the surface 46A of the body 12A, the joint therebetween can be brazed or welded to provide a sealed joint and securely attach the cap 14A to the body 12A. Also, the stem 34A is brazed or welded to the bottom wall of the piston body at the hole 74A. The brazing or welding material is indicated by the reference numeral 84A.

Thus, an inexpensive piston assembly results wherein the fluid passageway is remote from the outer side wall of the piston body and fluidly isolated from the cavity. Based upon the foregoing, it is apparent that the invention at least satisfies its stated objectives.

In the drawings and specification, there have been set forth preferred embodiments and examples relating to the invention, and although specific terms are employed, these are used in a generic and descriptive sense only and not for purposes of limitation. Changes in the form and the proportion of parts as well as in the substitution of equivalents are contemplated as circumstances may suggest or render expedient without departing from the spirit or scope of the invention as further defined in the following claims.

What is claimed is:

1. A piston assembly comprising:

a hollow piston body including opposite first and second ends, a continuous outer side wall and a bottom wall, the bottom wall and the side wall defining an interior cavity having an entrance formed in the first end, the bottom wall and the outer side wall each having an inner surface and an outer surface, the piston body having an interior cavity formed therein defined in part by the inner surface of the side wall and the inner surface of the bottom wall;

the piston body being of a one-piece unitary construction and including an elongated hollow stem integrally formed therein having a first end attached to the bottom wall and a second end protruding from the bottom wall toward the entrance of the cavity, the stem extending parallel to the outer surface of the side wall of the piston body; and a piston cap formed separately from the piston body and having first and second ends, the first end of the piston cap being sealingly joined to both the side wall of the piston body and the second end of the stem so as to prevent fluid from filling the cavity through the entrance and the stem.

2. The piston assembly of claim 1 wherein the second end of the piston cap has a slipper-engaging surface formed thereon.

3. The piston assembly of claim 2 comprising a slipper pivotally mounted to the piston cap at the slipper-engaging surface so as to define a slipper and piston assembly.

4. The piston assembly of claim 3 wherein the slipper has a fluid passageway extending therethrough, the fluid passageway through the slipper being generally registered with the fluid passageway through the piston cap.

5. The piston assembly of claim 1 wherein a rigid web connects the stem to the inner surface of the side wall by extending radially outward in a single direction from the stem alongside a portion of the stem.

6. The piston assembly of claim 5 wherein the second end of the stem protrudes above the web toward the piston cap.

7. The piston assembly of claim 1 wherein the hollow stem has a fluid passageway therein that extends longitudinally completely through stem and the bottom wall of the piston body.

8. The piston assembly of claim 1 wherein the piston body is cylindrical and the inner and outer surfaces are concentric to each other.

9. The piston assembly of claim 1 wherein the stem is cylindrical and centrally located within the cavity.

10. The piston assembly of claim 1 wherein a portion of the first end of the piston cap extends into the cavity of the piston body.

11. The piston assembly of claim 1 wherein the first end of the piston cap includes a straight inwardly and downwardly tapered conical outer surface thereon and the first end of the piston body includes a straight inwardly and downwardly tapered conical recessed surface thereon for complementary engagement with the conical outer surface on the cap.

12. The piston assembly of claim 1 wherein the first end of the piston cap has a centrally located recess therein for receiving the second end of the stem.

13. The piston assembly of claim 12 wherein the recess in the piston cap includes a hole for the receiving the second end of the stem and a countersink surrounding and leading into said hole for guiding the stem into said hole.

14. The piston assembly of claim 1 wherein piston cap has a fluid passageway extending longitudinally therethrough from the first end of the piston cap to the second end of the piston cap, the fluid passageway through the cap being generally registered with the fluid passageway through the stem when the cap is joined to the piston body.

15. The piston assembly of claim 1 wherein the piston body and the stem are molded together as a single unitary piece by metal injection molding.

16. The piston assembly of claim 1 wherein the piston cap, piston body and stem are metallic.

17. The piston assembly of claim 1 wherein the piston body and the cap are sealingly joined together to seal the interior cavity by brazing.

18. The piston assembly of claim 1 wherein the piston body and the cap are sealingly joined together to seal the interior cavity by welding.

19. The piston assembly of claim 1 wherein at least one rigid web connects the stem to the inner side wall by extending radially outward from the stem.

20. The piston assembly of claim 1 wherein a rigid web connects the stem to the inner surface of the side wall by extending radially outward from the stem.

21. A piston assembly comprising:

a hollow piston body including a continuous outer side wall and a bottom wall, the bottom wall and the side wall defining an interior cavity having an entrance formed opposite the bottom wall, the bottom wall having a hole therein extending into the cavity, the hole being offset from and parallel to the side wall;

a piston cap being of a one-piece unitary construction and formed separately from the piston body, the piston cap including an enlarged head portion adapted to cover the entrance to the cavity and an elongated stem having a first end attached to the head portion and a second end insertable into the cavity;

the second end of the stem being adapted to slidingly mate with the hole in the bottom wall in an axial direction, the stem having a length such that the second end extends through the cavity and into the hole in the bottom wall of the piston body when the head portion of the piston cap abuts the piston body at the entrance of the cavity;

the head portion of the piston cap being sealably joined to the piston body at the entrance to the cavity and the stem being sealingly joined to the bottom wall surrounding the hole;

the piston cap having a fluid passageway extending longitudinally through the stem and the head portion;

whereby, when the piston cap and piston body are sealably joined, the interior cavity is enclosed and the fluid passageway in the stem is fluidly isolated from the cavity.

22. The piston assembly of claim 21 wherein the head portion of the piston cap has a slipper-engaging surface formed thereon opposite the stem.

23. The piston assembly of claim 22 wherein the slipper-engaging surface is defined by a ball socket recess formed in the piston cap.

24. The piston assembly of claim 22 comprising a slipper pivotally mounted to the piston cap at the slipper-engaging surface so as to define a slipper and piston assembly.

25. The piston assembly of claim 24 wherein the slipper has a fluid passageway extending longitudinally therethrough, the fluid passageway through the slipper being generally registered with the fluid passageway through the piston cap.

26. The piston assembly of claim 25 wherein the stem is concentric with the head portion and the side wall of the piston body.

27. The piston assembly of claim 21 wherein the piston body is generally cylindrical and the side wall is defined by concentric inner and outer cylindrical surfaces.

28. The piston assembly of claim 21 wherein the head portion has a convex spherical outer surface adjacent the stem and the piston body has a concave spherical surface thereon outwardly adjacent the entrance to the cavity for mating with the convex spherical surface of the cap.

29. The piston assembly of claim 21 wherein the piston cap, piston body and stem are metallic.

30. The piston assembly of claim 21 wherein the piston body and the cap are sealingly joined together to seal the interior cavity by brazing.

31. The piston assembly of claim 21 wherein the piston body and the cap are sealingly joined together to seal the interior cavity by welding.

32. The piston assembly of claim 21 wherein the piston cap and the stem are molded together as a single unitary piece by metal injection molding.

33. The piston assembly of claim 21 wherein the fluid passageway through the piston cap and the stem is centrally located.

* * * * *